US005502847A

United States Patent [19]

Weeks

[11] Patent Number: 5,502,847

[45] Date of Patent: Apr. 2, 1996

[54] TOILET TANK FLUSH ACTUATOR

[76] Inventor: Glenn D. Weeks, 2609 N. Pines Rd., Apt. 15, Spokane, Wash. 99206

[21] Appl. No.: 369,461

[22] Filed: Jan. 6, 1995

[51] Int. Cl.[6] ..... E03D 5/09

[52] U.S. Cl. ..... 4/411

[58] Field of Search ..... 4/405–414, 250, 4/249, 246.2

[56] References Cited

U.S. PATENT DOCUMENTS 920,928 5/1909 Davis ..... 4/408
2,529,632 11/1950 Russell et al. ..... 4/243
3,883,904 5/1975 Wittman ..... 4/411 X
5,319,810 6/1994 Metzger ..... 4/408
5,369,816 12/1994 Chen ..... 4/411 X

*Primary Examiner*—Charles E. Phillips

[57] ABSTRACT

An actuator for operating a flush valve of a toilet. The inventive device includes a mounting assembly for securing to a tank of a toilet. An actuating assembly is slidably secured to the mounting assembly along an exterior thereof for actuating a flush valve of the associated toilet. The actuator can be positioned relative to a toilet tank behind an uplifted seat thereof to encourage closing of the seat prior to flushing of the toilet.

5 Claims, 4 Drawing Sheets

TOILET TANK FLUSH ACTUATOR

BACKGROUND OF THE INVENTION

1. Field of the Invention

The present invention relates to toilet operating devices and more particularly pertains to an toilet tank flush actuator for operating a flush valve of a toilet.

2. Description of the Prior Art

The use of toilet operating devices is known in the prior art. More specifically, toilet operating devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art toilet operating devices include U.S. Pat. Nos. 5,280,653; 5,177,818; 5,056,165; 5,054,131; and 4,338,690.

While these devices fulfill their respective, particular objectives and requirements, the aforementioned patents do not disclose a toilet tank flush actuator for operating a flush valve of a toilet which includes a mounting assembly for securing to a tank of a toilet, and an actuating assembly slidably secured to the mounting assembly along an exterior thereof for actuating a flush valve of the associated toilet, wherein the actuator can be positioned relative to a toilet tank behind an uplifted seat thereof to encourage closing of the seat prior to flushing of the toilet.

In these respects, the toilet tank flush actuator according to the present invention substantially departs from the conventional concepts and designs of the prior art, and in so doing provides an apparatus primarily developed for the purpose of operating a flush valve of a toilet.

SUMMARY OF THE INVENTION

In view of the foregoing disadvantages inherent in the known types of toilet operating devices now present in the prior art, the present invention provides a new toilet tank flush actuator construction wherein the same can be utilized for operating a flush valve of a toilet and encouraging closure of a toilet seat of the toilet. As such, the general purpose of the present invention, which will be described subsequently in greater detail, is to provide a new toilet tank flush actuator apparatus and method which has many of the advantages of the toilet operating devices mentioned heretofore and many novel features that result in a toilet tank flush actuator which is not anticipated, rendered obvious, suggested, or even implied by any of the prior art toilet operating devices, either alone or in any combination thereof.

To attain this, the present invention generally comprises an actuator for operating a flush valve of a toilet. The inventive device includes a mounting assembly for securing to a tank of a toilet. An actuating assembly is slidably secured to the mounting assembly along an exterior thereof for actuating a flush valve of the associated toilet. The actuator can be positioned relative to a toilet tank behind an uplifted seat thereof to encourage closing of the seat prior to flushing of the toilet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet tank flush actuator apparatus and method which has many of the advantages of the toilet operating devices mentioned heretofore and many novel features that result in a toilet tank flush actuator which is not anticipated, rendered obvious, suggested, or even implied by any of the prior art toilet operating devices, either alone or in any combination thereof.

It is another object of the present invention to provide a new toilet tank flush actuator which may be easily and efficiently manufactured and marketed.

It is a further object of the present invention to provide a new toilet tank flush actuator which is of a durable and reliable construction.

An even further object of the present invention is to provide a new toilet tank flush actuator which is susceptible of a low cost of manufacture with regard to both materials and labor, and which accordingly is then susceptible of low prices of sale to the consuming public, thereby making such toilet tank flush actuators economically available to the buying public.

Still yet another object of the present invention is to provide a new toilet tank flush actuator which provides in the apparatuses and methods of the prior art some of the advantages thereof, while simultaneously overcoming some of the disadvantages normally associated therewith.

Still another object of the present invention is to provide a new toilet tank flush actuator for operating a flush valve of a toilet.

Yet another object of the present invention is to provide a new toilet tank flush actuator which includes a mounting assembly for securing to a tank of a toilet, and an actuating assembly slidably secured to the mounting assembly along an exterior thereof for actuating a flush valve of the associated toilet.

Even still another object of the present invention is to provide a new toilet tank flush actuator wherein the actuator can be positioned relative to a toilet tank behind an uplifted seat thereof to encourage closing of the seat prior to flushing of the toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
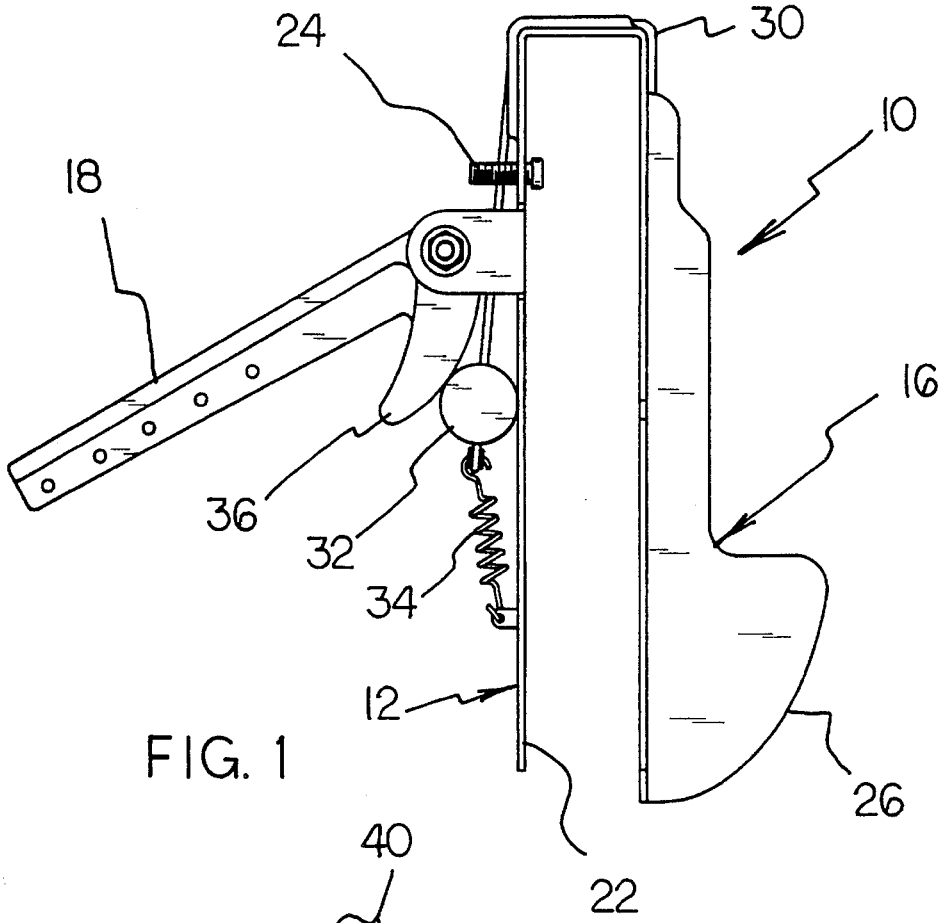
FIG. 1 is a side elevation view of a toilet tank flush actuator according to the present invention.

With reference now to the drawings, and in particular to FIGS. 1–8 thereof, a new toilet tank flush actuator embodying the principles and concepts of the present invention and generally designated by the reference numeral 10 will be described.

Figure 5:
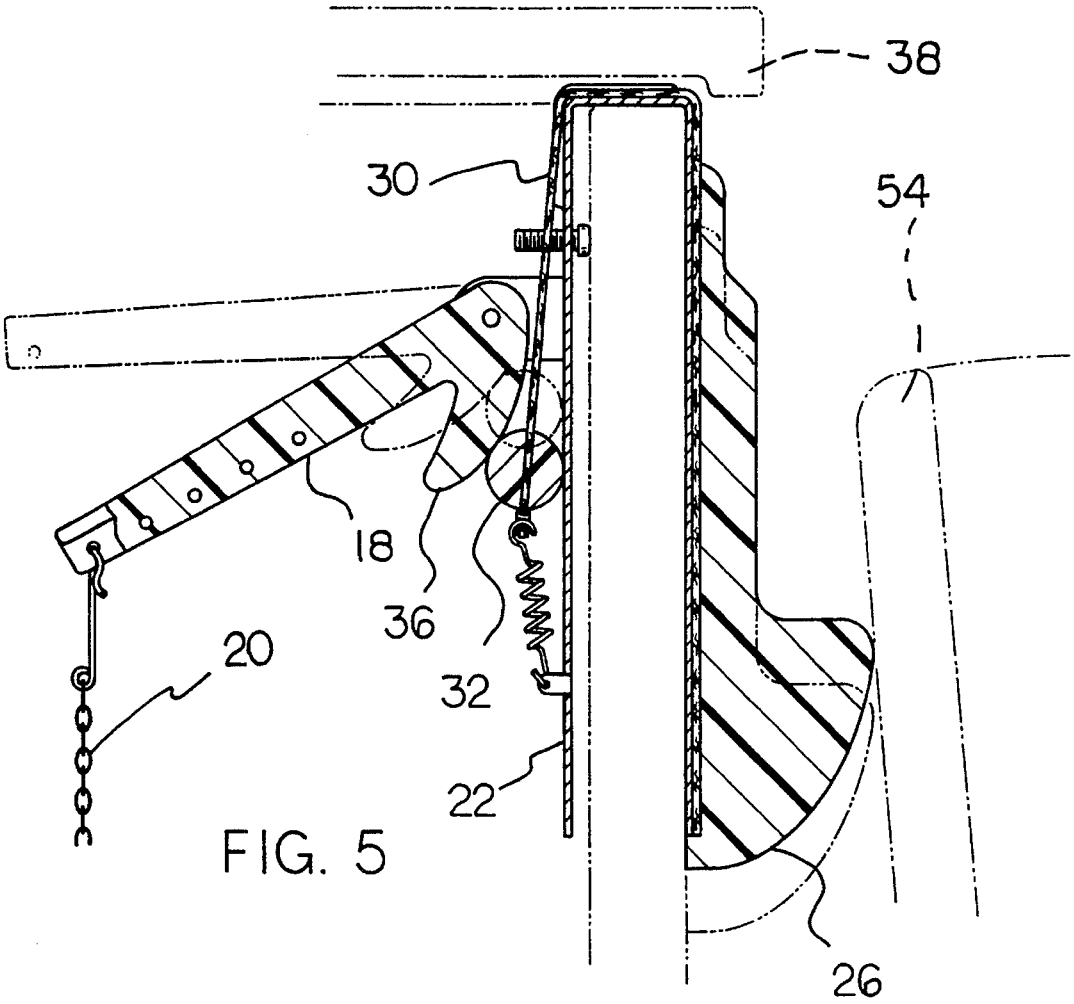
FIG. 5 is a cross-sectional view of the present invention in use.

More specifically, it will be noted that the toilet tank flush actuator 10 comprises a mounting means 12 for securing to a portion of a toilet tank 14, as shown in FIG. 5, so as to extend along both interior and exterior surfaces thereof. An actuating means 16 is slidably mounted to an exterior of the mounting means 12 and communicates with an interior of the mounting means to effect pivoting of a lever 18 mounted to an interior portion of the mounting means. The lever 18 can be coupled to an unillustrated flush valve by a chain 20, as shown in FIG. 5 to effect operation of the flush valve as a result of an operation of the actuating means 16.

Figure 2:
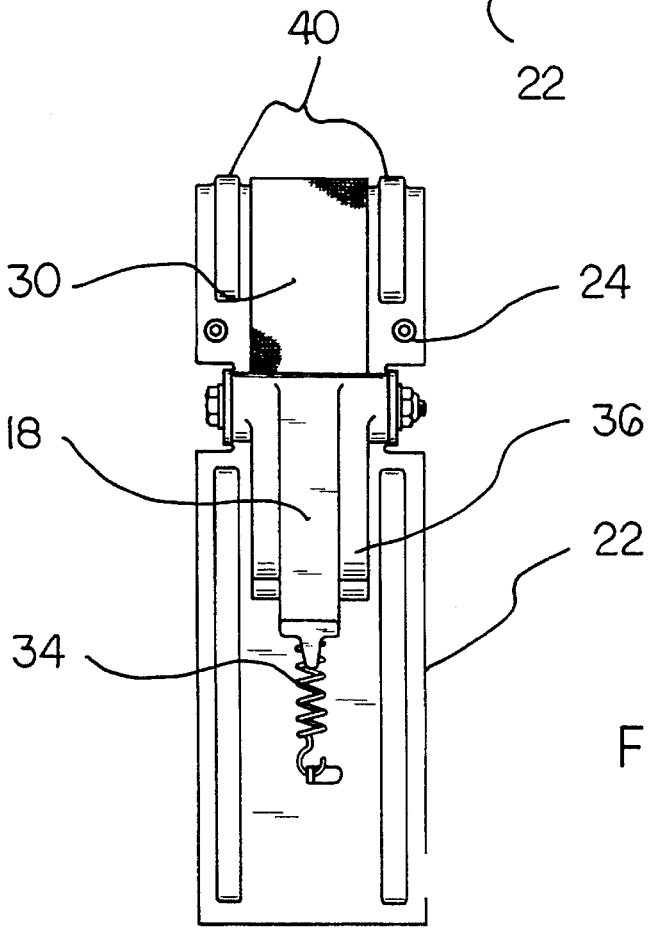
FIG. 2 is a rear elevation view thereof.

As best illustrated in FIGS. 1 through 5 of the drawings, it can be shown that the mounting means 12 according to the present invention 10 preferably comprises a substantially U-shaped mounting bracket 22 positionable over a portion of the toilet tank 14 so as to extend along opposed interior and exterior surfaces thereof substantially as shown in the drawings. Thus, the U-shaped mounting bracket 22 has an interior transverse dimension substantially greater than a thickness of the toilet tank 14 to which it is to be associated. As shown in FIGS. 1 and 2, a plurality of set screws 24 can be directed through a portion of the mounting bracket 22 to effect further securement of the mounting means 12 to the toilet tank 14 through a rotational advancing of the set screws as desired.

Figure 3:
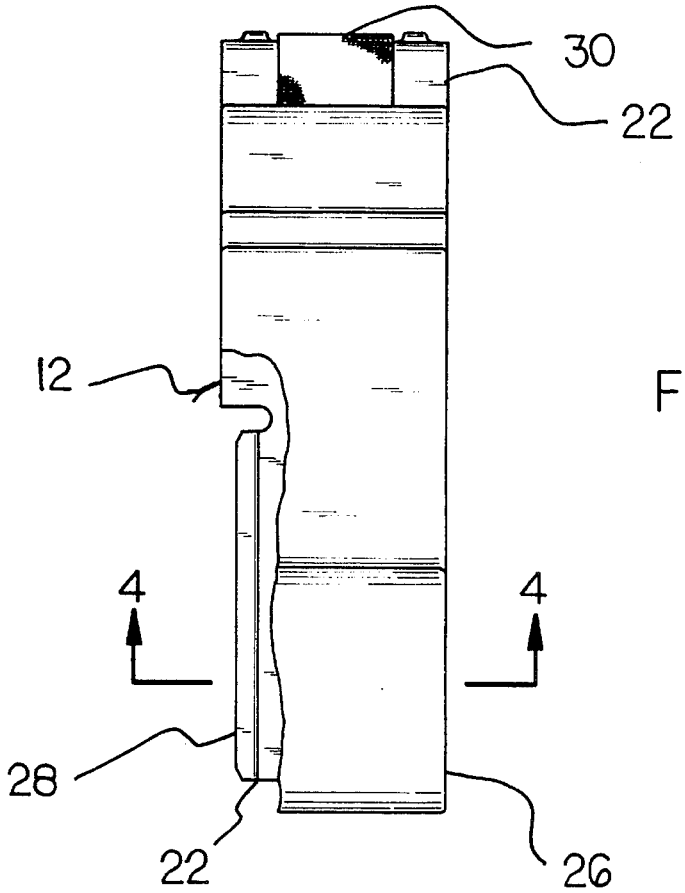
FIG. 3 is a front elevation view, partially in cross-section, of the present invention.
Figure 4:
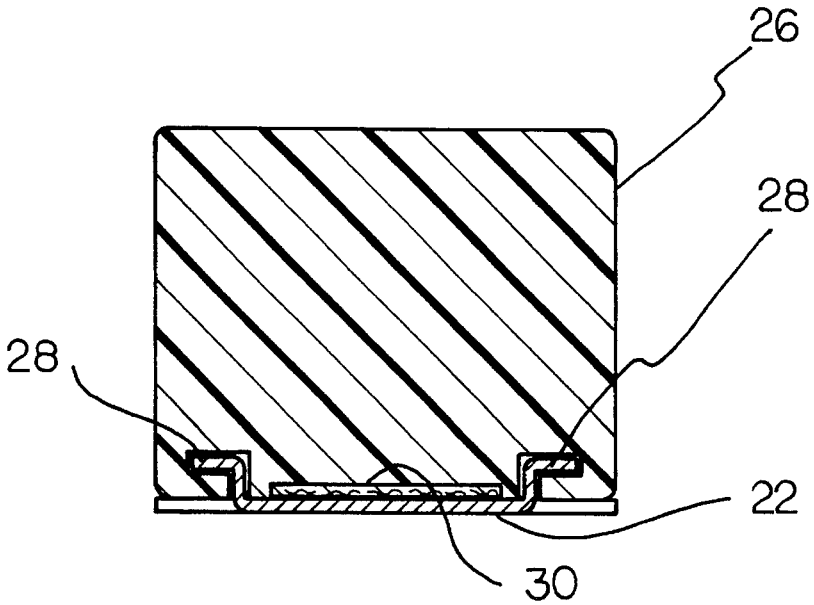
FIG. 4 is a cross-sectional view taken along line 4—4 of FIG. 3.

With continuing reference to FIGS. 1 through 5, it can be shown that the actuating means 16 according to the present invention 10 comprises a sliding member 26 which is slidably mounted to an exterior portion of the mounting means 12. To this end, and as shown in FIG. 3, the U-shaped mounting bracket 22 of the mounting means 12 is preferably shaped so as to define a pair of tracks 28 which engage cooperatively configured and unlabelled journals formed within the sliding member 26. The tracks 28 cooperate with the journals of the sliding member 26 to thus movably couple the sliding member 26 along an exterior surface of the mounting means 12.

The actuating means 16 of the present invention 10, in addition to the sliding member 26, further comprises a strap 30 coupled to the sliding member 26 which extends over the U-shaped mounting bracket 22 to terminate proximal to an interior surface of the mounting means 12. A cam 32 is coupled to an interior end of the strap 30 and resiliently biased towards a lower end of the mounting bracket 22 by a spring 34 attached to both the cam and a portion of the mounting means 12. The cam 32 slidably engages an interior surface of the mounting means 12 and can be translated vertically therealong through a depression of the sliding member 26 as shown in FIG. 5 of the drawings. The lever 18 is pivotally mounted to an interior surface of the mounting means 12 and includes a follower 36 projecting therefrom which engages the cam 32 as shown in FIG. 1. Thus, a depression of the sliding member 26 will effect movement of the cam 32 against an interior surface of the mounting means 12 and a surface of the follower 36 to cause the lever 18 to pivot relative to the mounting means 12. By this structure, an operation of a flush valve within an associated toilet can be accomplished exteriorly of the toilet tank 14.

To permit placement of a tank cover 38 across an upper opening of the toilet tank 14 while still permitting sliding translation of the strap 30 across an upper end of the mounting bracket 22, the mounting bracket is desirably shaped so as to include spacing projections 40 extending along opposed sides of the strap 30 substantially as shown in FIG. 2 of the drawings.

Figure 6:
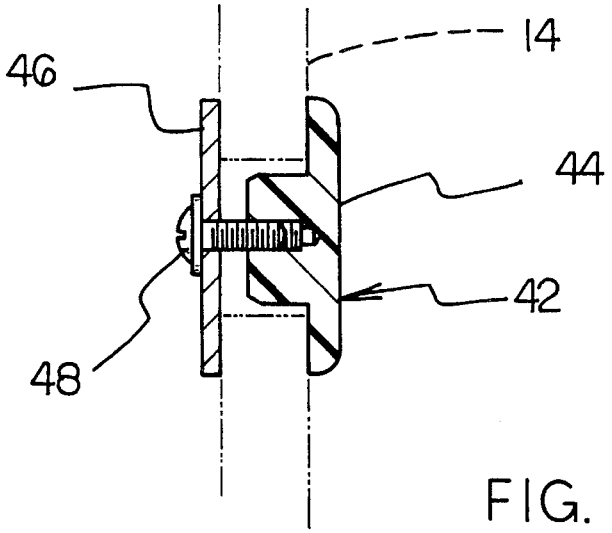
FIG. 6 is a cross-sectional view of a plug means for use with the present invention.

As shown in FIG. 6, the present invention 10 can be utilized to replace an existing pivoting flush lever conventionally known in the toilet art. To this end, a plug means 42 can be provided for closing a circular aperture formed in the toilet tank 14 of a conventional toilet. The plug means 42 comprises a plug member 44 positionable upon an exterior surface of the toilet tank 14, and a washer 46 positionable along an interior surface of the toilet tank, with a fastener 48 projecting through the washer 46 and threadably engaging the plug member 44 to secure the components 44–46 relative to the toilet tank 14.

Figure 7:
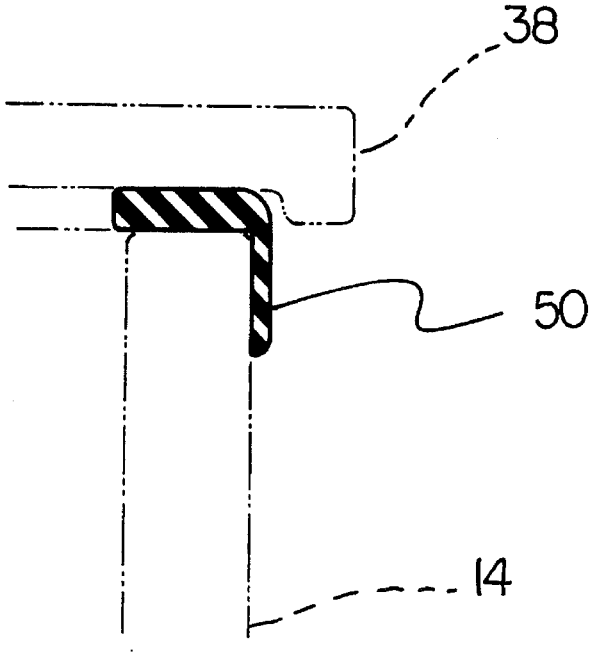
FIG. 7 is a cross-sectional view of a spacer for use with the present invention.
Figure 8:
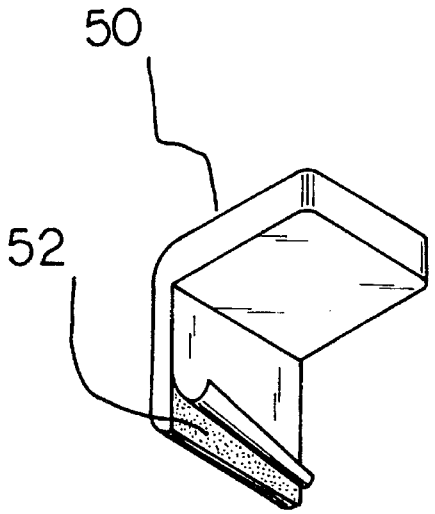
FIG. 8 is an isometric illustration of an individual spacer.

Referring now to FIGS. 7 and 8, it can be shown that the present invention 10 may further include a plurality of spacers 50 positionable between the toilet tank 14 and the tank cover 38 so as to substantially align the tank cover relative thereto and compensate for a thickness of the upper transverse portion of the mounting bracket 22. To this end, the spacers 50 are preferably attached to the toilet tank 14 by an adhesive 52 applied to interior surfaces of the spacers.

In use, the toilet tank flush actuator 10 according to the present invention can be easily installed or retrofitted onto an existing toilet structure. Preferably, the device 10 is positioned so as to reside behind an uplifted toilet lid 54 of the associated toilet, as shown in FIG. 5, such that a user is encouraged to close the toilet lid prior to flushing of the toilet. In this configuration, the present invention 10 encourages safe, clean, and polite toilet manners from users of the associated toilet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet tank flush actuator comprising:

a mounting means for securing to a portion of a toilet tank comprising a substantially U-Shaped mounting bracket positionable over a portion of the toilet tank and secured thereto by a plurality of set screws directed through a portion of said mounting bracket so as to extend along opposed interior and exterior surfaces thereof, the U-shaped mounting bracket having an interior transverse dimension substantially greater than a thickness of the toilet tank;

a lever pivotally mounted to an interior of the mounting means for placement within the toilet tank and for coupling to a flush valve of the toilet tank;

an actuating means slideably mounted to an exterior of said mounting means and communicating with the interior of the mounting means;

wherein the actuating means comprises a sliding member slidably mounted to the exterior portion of the mounting means; a strap coupled to the sliding member and extending over the U-shaped mounting bracket to terminate proximal to the interior surface of the mounting means; a cam coupled to an interior end of the strap, the cam slidably engages an interior surface of the mounting means and being translatable vertically therealong through a depression of the sliding member; and a follower projecting from the lever, the cam being engaged to the follower such that a depression of the sliding member will effect movement of the cam against an interior surface of the mounting means and a surface of the follower to cause the lever to pivot relative to the mounting means to cause the flush valve to be actuated.

2. The toilet tank flush actuator of claim 1, wherein the U-shaped mounting bracket of the mounting means is shaped so as to define a pair of tracks which engage cooperatively configured journals formed within the sliding member to slidably mount the sliding member relative to an exterior surface of the mounting means.

3. The toilet tank flush actuator of claim 2, wherein the mounting bracket is shaped so as to include spacing projections extending along an upper transverse portion thereof on opposed sides of the strap to permit placement of a tank cover across an upper opening of the toilet tank while still permitting sliding translation of the strap across an upper end of the mounting bracket.

4. The toilet tank flush actuator of claim 3, and further comprising a plug means for closing a circular aperture formed in the toilet tank of a toilet.

5. The toilet tank flush actuator of claim 4, and further comprising a plurality of spacers positionable between the toilet tank and the tank cover so as to substantially align the tank cover relative thereto and compensate for a thickness of the upper transverse portion of the mounting bracket.

* * * * *